US006506984B2

(12) United States Patent
Tomita

(10) Patent No.: US 6,506,984 B2
(45) Date of Patent: Jan. 14, 2003

(54) ROTARY SWITCH HAVING CLICK MECHANISM

(75) Inventor: Koji Tomita, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/954,465

(22) Filed: Sep. 12, 2001

(65) Prior Publication Data

US 2002/0036130 A1 Mar. 28, 2002

(30) Foreign Application Priority Data

Sep. 28, 2000 (JP) ..... 2000-300580

(51) Int. Cl.[7] ..... H01H 19/58; H01H 21/78

(52) U.S. Cl. ..... 200/11 R; 200/11 A; 200/11 D; 200/564; 338/162

(58) Field of Search ..... 200/11 R, 11 DA, 200/11 G, 11 A, 11 D, 564, 565, 567, 568, 569, 570, 571, 336; 338/162

(56) References Cited

U.S. PATENT DOCUMENTS 5,008,498 A * 4/1991 Yamazaki ..... 200/11 R
5,315,077 A * 5/1994 Simon et al. ..... 200/11 R
5,650,601 A * 7/1997 Krueger et al. ..... 200/61.86
6,037,856 A * 3/2000 Aizawa ..... 338/162
6,236,002 B1 * 5/2001 Chou ..... 200/4
6,262,378 B1 * 7/2001 Chou ..... 200/4
6,374,696 B1 * 4/2002 Blake, III et al. ..... 74/527
6,384,357 B1 * 5/2002 Morrison ..... 200/520

FOREIGN PATENT DOCUMENTS

JP 10-199371 7/1998

* cited by examiner

*Primary Examiner*—Michael Friedhofer
*Assistant Examiner*—Kyung S. Lee
(74) *Attorney, Agent, or Firm*—Beyer Weaver & Thomas

(57) ABSTRACT

A switch device reduces a switching sound (an impinging sound) at the time of manipulation with a constitution of a click mechanism which uses a spring member having a projection which is brought into slide contact with a cam surface formed of plateaus and valleys. The switch device includes a manipulating member having a cam surface which is formed of plateaus and valleys arranged contiguously and alternately and a spring member having the projection and generating a click feeling when the projection is brought into slide contact with the plateaus and the valleys of the cam surface. The spring member is provided with an auxiliary spring which is brought into slide contact with the manipulating member corresponding to the slide contact of the projection with the plateaus and the valleys of the cam surface. An auxiliary spring receiving portion with which the auxiliary spring is brought into slide contact is formed in the vicinity of the cam surface.

7 Claims, 3 Drawing Sheets

ROTARY SWITCH HAVING CLICK MECHANISM

BACKGROUND OF THE INVENTION

1. Field of the Invention

The present invention relates to a switch device, and more particularly to a structure of a rotary switch device having a click mechanism which is used in various electronic equipment for household or vehicle mounting.

2. Description of the Prior Art

A structure of a conventional rotary switch device having a click mechanism is shown in FIG. 5. FIG. 5 is an exploded perspective view of the rotary switch device.

This conventional rotary switch device includes a resin-made housing 11 which has a support shaft 11*a* at the center of an accommodating portion 11*b*, a fixed terminal portion 12 which is arranged in the accommodating portion 11*b* of the housing 11, a circuit board 13 which has a contact portion which is brought into slide contact with a slider 12*a* of the fixed terminal portion 12, a rotary manipulating portion 14 which has the circuit board 13 fixedly secured to a lower surface side thereof, is rotatably supported on the support shaft 11*a* of the housing 11 and has a cam surface 14a which alternately forms plateaus and valleys on an upper surface thereof, a spring member 15 which is disposed such that the spring member 15 faces the cam surface 14*a* in an opposed manner and has a projection 15*a* which is brought into slide contact with the cam surface 14*a*, and a frame 16 which has a lower surface side thereof to which the spring member 15 is fixedly secured and is fitted on an upper surface side of the housing 11.

A click mechanism of this rotary switch device is comprised of the cam surface 14*a* which is formed on the upper surface side of the rotary manipulation portion 14 and is constituted of the plateaus and the valleys, and the spring member 15 which has the projection 15*a* which is brought into slide contact with the cam surface 14*a*. To manipulate the rotary switch device, a rotary manipulation tab not shown in the drawing which is protruded from the frame 16, is mounted on the upper surface side of the rotary manipulating portion 14 and is rotatably manipulated with a hand or the like. Along with the rotation of the rotary manipulating portion 14, the projection 15*a* is moved between the plateau and the valley and when the projection 15*a* gets over the plateau and falls in the valley, the spring member 15 is deflected so that a click feeling is generated.

Then, along with the rotation of the rotary manipulating portion 14, the contact portion which is disposed at the circuit board 13 is brought into slide contact with the slider 12*a* of the fixed terminal portion 12 which is disposed such that the slider 12*a* faces the contact portion in an opposed manner so as to perform the switching of a circuit.

However, in the abovementioned constitution of the conventional rotary switch device, when the rotary manipulating portion 14 is manipulated, at a point of time that the projection 15*a* of the spring member 15 is slidably moved on the plateaus and the valleys of the cam surface 14*a* and falls in the valley after getting over the plateau, the projection 15*a* suddenly impinges on the cam surface or generates vibration due to the resiliency of the spring member 15 so that there has been a drawback that the a switching sound (an impinging sound) at the time of manipulation is large.

Accordingly, the present invention has been made to solve the abovementioned drawback and it is an object of the present invention to provide a switch device which can reduce or attenuate a switching sound (an impinging sound) at the time of manipulation with a constitution of a click mechanism which uses a spring member having a projection which is brought into slide contact with a cam surface formed of plateaus and valleys.

SUMMARY OF THE INVENTION

To solve the abovementioned drawbacks, according to a first aspect of the present invention, there is provided a switch device which includes a housing having an accommodating portion, a manipulating member having a cam surface which is formed of plateaus and valleys arranged contiguously and alternately, the manipulating member movably disposed in the accommodating portion, and a spring member having a projection and generating a click feeling when the projection is brought into slide contact with the plateaus and the valleys of the cam surface, wherein an auxiliary spring which is brought into slide contact with the manipulating member corresponding to the slide contact of the projection with the plateaus and the valleys of the cam surface is formed on the spring member, wherein and an auxiliary spring receiving portion with which the auxiliary spring is brought into slide contact is formed in the vicinity of the cam surface.

According to a second aspect of the present invention, the auxiliary spring is integrally formed with one end of the spring member by forming a portion of the spring member.

According to a third aspect of the present invention, the auxiliary spring is formed such that a pressing force applied to the auxiliary spring receiving portion becomes maximum when the projection is engaged with the valley of the cam surface.

According to a fourth aspect of the present invention, the auxiliary spring receiving portion is formed on the manipulating member such that the auxiliary spring receiving portion forms an integral coplanar surface with the cam surface.

According to a fifth aspect of the present invention, the auxiliary spring is formed such that the auxiliary spring is in a slidable contact in the state that the auxiliary spring always stays in contact with the planar auxiliary spring receiving portion when the manipulating member is moved.

According to a sixth aspect of the present invention, a support shaft formed in a cylindrical shape is mounted on the center of the accommodating portion of the housing, the manipulating member allows insertion of the support shaft thereinto and is rotatably supported by the support shaft, the cam surface and the spring member having the projection which faces the cam surface in an opposed manner are disposed in a vertical direction relative to the support shaft, and a portion of the spring member is extended along a circumferential direction of rotation of the manipulating member from a position in the vicinity of the projection so as to form the auxiliary spring, and a free end of the auxiliary spring is brought into contact with the auxiliary spring receiving portion.

According to a seventh aspect of the present invention, the auxiliary spring is symmetrically extended toward both sides of the circumferential direction of the rotation of the manipulating member with respect to the projection.

PREFERRED EMBODIMENTS OF THE PRESENT INVENTION

Figure 1:
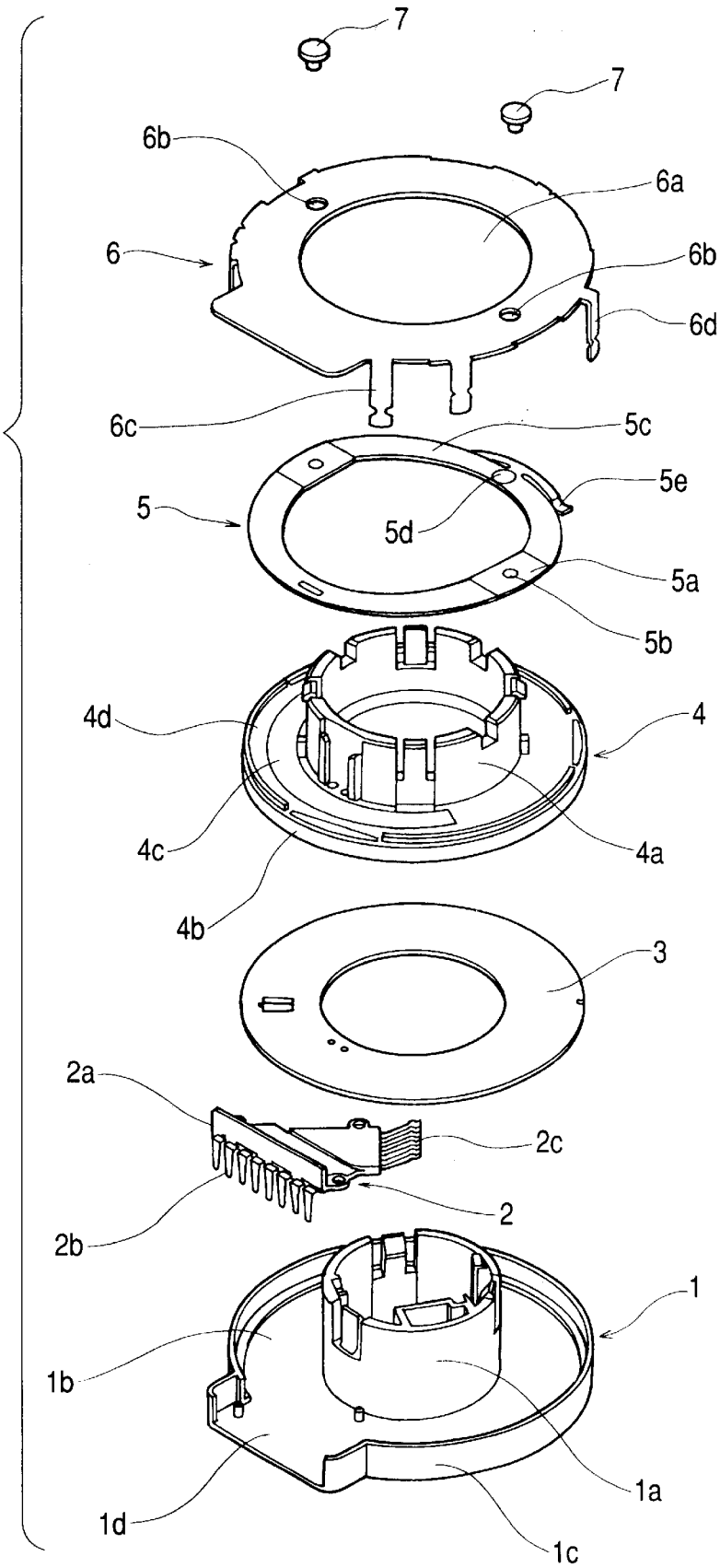
FIG. 1 is an exploded perspective view showing a rotary switch device according to a first embodiment of the present invention.
Figure 2:
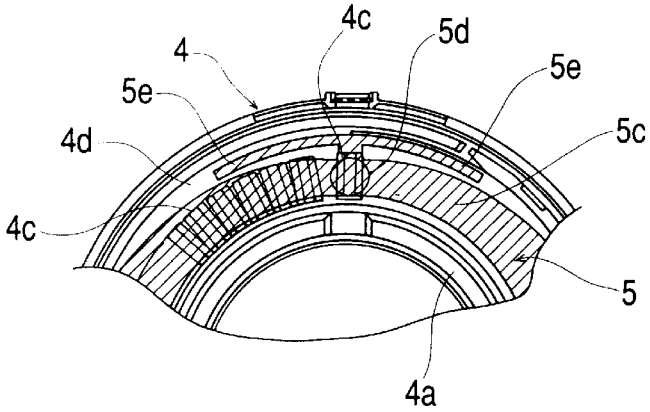
FIG. 2 is a partial explanatory view showing the relationship between a cam surface and a spring member of the rotary switch device of the present invention.
Figure 3:
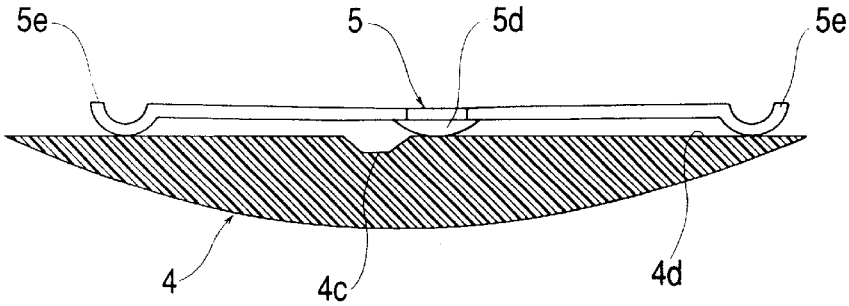
FIG. 3 is a partial explanatory view showing the state in which a projection of the spring member of the present invention is positioned at a plateau of the cam surface.
Figure 4:
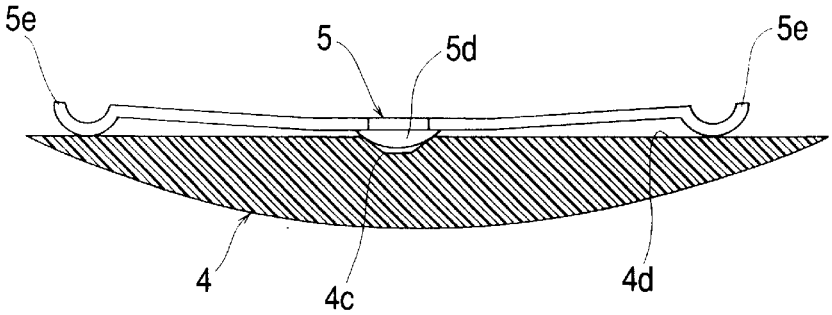
FIG. 4 is a partial explanatory view showing the state in which the projection of the spring member of the present invention is positioned at a valley of the cam surface.
Figure 5:
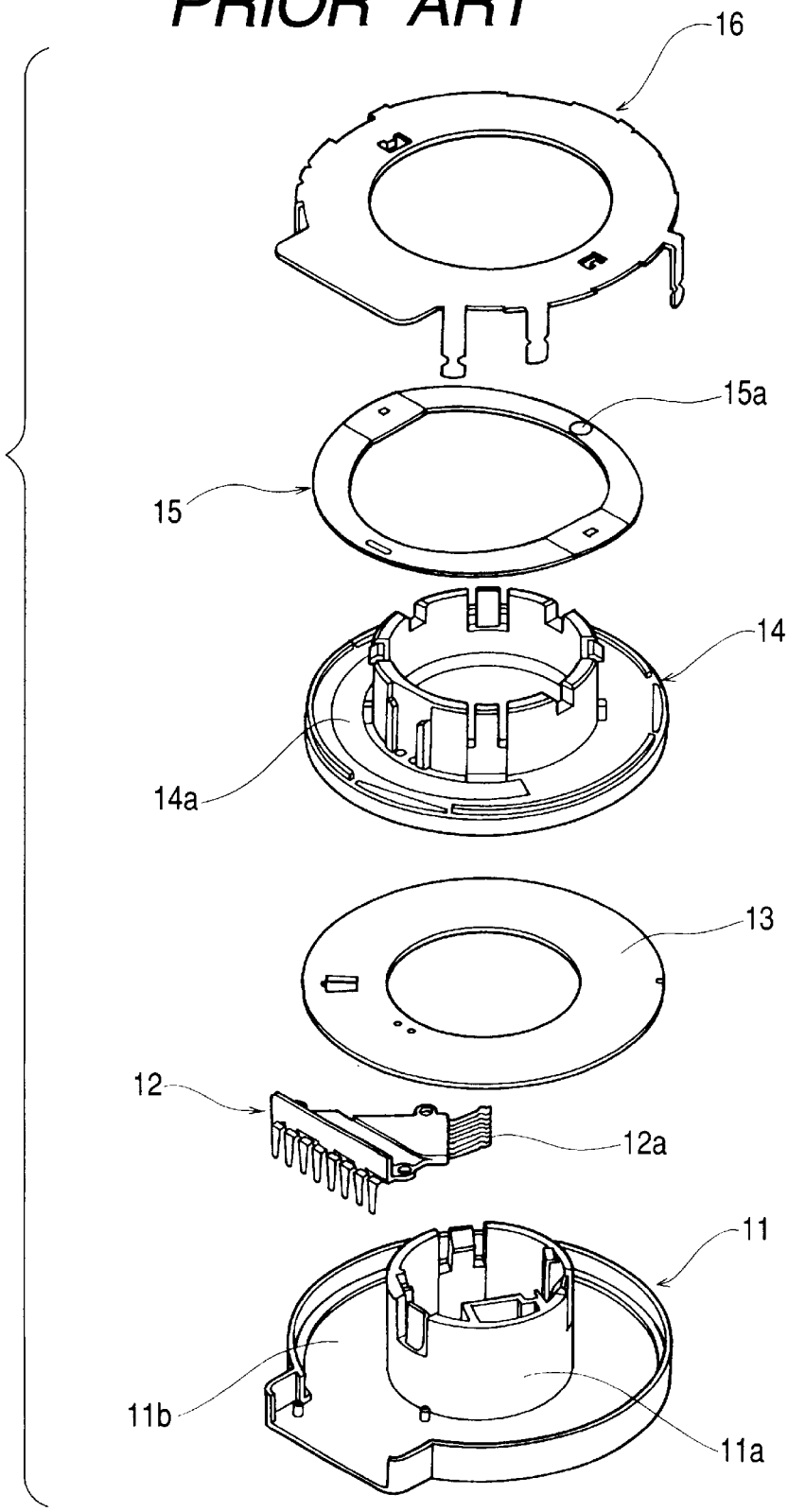
FIG. 5 PRIOR ART
FIG. 5 is an exploded perspective view showing a conventional rotary switch device.

One embodiment of the present invention is shown in FIG. 1 to FIG. 4. FIG. 1 is an exploded perspective view showing a rotary switch device, FIG. 2 is a partial explanatory view showing the relationship between a cam surface and a spring member, FIG. 3 is a partial explanatory view showing the state in which a projection of the spring member is positioned at a plateau of the cam surface, and FIG. 4 is a partial explanatory view showing the state in which the projection of the spring member is positioned at a valley of the cam surface.

In the drawings, a housing 1 is made of insulation material such as synthetic resin or the like and is substantially formed in an annular shape having a hollow portion at the center thereof. A hollow cylindrical support shaft 1*a* is formed at the center of the housing 1, while a base disc portion 1*b* which has an accommodating portion 1*b* of an approximately annular shape with an open upper surface is formed at the lower end side of the support shaft 1*a*. Further, on one end of the base disc portion 1*c*, an opening portion 1*d* which allows a connection terminal 2*b* which will be explained later to be pulled out from the base disc portion 1*c* is formed.

A fixed terminal portion 2 is formed such that a terminal member which is made of a conductive metal plate is embedded into a base 2*a* which is made of insulation material such as synthetic resin. A plurality of connection terminals 2*b* are arranged at one end side of the base 2*a* and these connection terminals 2*b* are pulled out through the opening portion 1*d* of the housing 1. Further, at the other end of the base 2*a*, a plurality of sliders 2*c* are arranged and these sliders 2*c* and the connection terminals 2*b* are embedded in the inside of the base 2*a* in the state that they are communicated with each other.

A circuit board 3 is formed of a laminated plate made of phenol resin or the like and is formed in an approximately annular shape . A through hole 3*a* is formed in the center of the circuit board 3 such that the circuit board 3 is rotatably engaged with the support shaft 1*a* of the housing 1. A plurality of contact portions not shown in the drawing which are brought into slide contact with the sliders 2*c* are formed on one surface of the circuit board 3 in an annular shape. The circuit board 3 is fixedly secured to a lower side of a rotary plate 4 which will be explained later such that along with the rotation of the rotary plate 4, the contact portions are brought into contact with the sliders 2*c* to perform the changeover of the switch.

The rotary plate 4 which constitutes a manipulating member is made of insulation material such as synthetic resin or the like and also has a central portion thereof formed in a hollow annular shape. A rotary shaft 4*a* having a cylindrical shape is formed on the center of the rotary plate 4. The rotary shaft 4*a* is rotatably engaged with the support shaft 1*a* around the support shaft 1*a* of the housing 1. Further, at the lower end side of the rotary shaft 4*a*, a disc-like rotary base portion 4*b* which is rotatably accommodated in the accommodating portion 1*b* of the base disc portion 1*c* is provided. The rotary base 4*b* has a lower end side thereof fixedly secured to the circuit board 3 which is provided with the contact portions which faces the sliders 2*c* provided to the accommodating portion 1*b* in an opposed manner.

Further, with respect to the rotary plate 4, an undulating cam surface 4*c* which is constituted of a plurality of plateaus and valleys is formed on an upper surface of the rotary base portion 4*a*. By bringing a projection 5*d* of a spring member 5 which will be explained later into slide contact with the cam surface 4*c*, a click feeling can be obtained at the time of rotary manipulation of the rotary plate 4. Further, in the vicinity of the cam surface 4*c*, an auxiliary spring receiving portion 4*d* which becomes integrally coplanar with the cam surface 4*c* is formed and an auxiliary spring 5*e* of the spring member 5 which will be explained later is brought into slide contact with the auxiliary spring receiving portion 4*d*.

The spring member 5 is made of a metal plate having resiliency and is formed in an approximately annular shape. A pair of flat portions 5*a* are formed on the spring member 5 at opposing positions of a straight line which passes approximately a center of the spring member 5. Caulking holes 5*b* for mounting the spring member 5 to a frame 6 which will be explained later are formed in these flat portions 5*a*. Further, the spring member 5 has portions thereof disposed at both sides of the flat portions 5*a* which act as boundaries bent in an approximately V-shape to form resilient arm portions 5*c*. On the center of one of these bent resilient arm portions 5*c*, the projection 5*d* which is protruded in the direction which faces the cam surface 4*c* of the rotary plate 4 is formed.

Further, with respect to this spring member 5, a portion of the spring member 5 is extended from a position in the vicinity of the projection 5*d* and an auxiliary spring 5*e* having an approximately T-shape which is extended in the circumferential direction along which the rotary plate 4 is rotated is formed. Corresponding to the slide contact of the projection 5*d* with the plateaus and valleys of the cam surface 4*c*, free ends of the auxiliary spring 5*e* are brought into slide contact with the auxiliary spring receiving portion 4*d* which is integrally formed with the cam surface 4*c* of the rotary plate 4 as the coplanar surface. Further, the auxiliary spring 5*e* is formed such that the auxiliary spring 5*e* is extended uniformly or symmetrically in both side directions with respect to the projection 5*d* along the circumferential direction along which the rotary plate 4 is rotated. Further, the auxiliary springs 5*e* is integrally formed with the spring member 5 by forming a portion of the spring member 5 on one end of the spring member 5.

Here, the auxiliary spring 5*e* is formed such that the pressing force of the auxiliary spring 5*e* to the auxiliary spring receiving portion 4*d* becomes maximum at a point of time that the projection 5*d* is engaged with the valley of the cam surface 4*c*. Further, the auxiliary spring 5*e* is formed such that the auxiliary spring 5*e* is in slide contact in the state that the auxiliary spring 5*e* always stays in contact with the planar auxiliary spring receiving portion 4*d* when the rotary plate 4 is rotated.

The frame 6 is made of a metal plate in a flat-plate shape and is formed in an approximately annular shape. A window hole 6*a* which allows the rotary shaft 4*a* of the rotary plate 4 pass therethrough is formed on the center of the frame 6. Further, a pair of mounting holes 6*b* for mounting the spring member 5 to a lower surface of the frame 6 are formed on the frame 6. That is, in the state that the mounting hole 6*b* is aligned with caulking holes 5*b* formed in the spring member 5, rivets 7 are inserted into these holes 6*b*, 5*b* and the rivets 7 are caulked so as to fixedly secure the spring member 5 to the frame 6.

In fixedly securing the spring member 5 to the frame 6, in place of the rivets 7, a burring may be performed such that portions of the frame 6 are protruded downwardly thus forming caulking portions.

Further, the frame 6 is provided with a plurality of engaging lugs 6c which are served for mounting the frame 6 to the housing 1 and a mounting leg 6*d* which is served for mounting the frame 6 to electronic equipment or the like.

Subsequently, the manner of operation of the rotary switch device according to this embodiment is explained.

First of all, when the rotary shaft 4*a* of the rotary plate 4 which constitutes the manipulating member is rotatably manipulated using a rotary tab or the like not shown in the drawing which is mounted on the rotary shaft 4*a* with a hand, the rotary plate 4 is rotatably operated in one direction about the support shaft 1*a* of the housing 1.

In this operation, the cam surface 4*c* which is constituted of the plateaus and the valleys formed on the upper surface side of the rotary plate 4 and the projection 5*d* which is formed on the resilient arm portion 5*c* of the spring member 5 which is arranged to face the cam surface 4*c* in an opposed manner are brought into slide contact with each other and, when the projection 5*d* gets over the plateau and falls in the valley due to the slide movement, a click feeling at the time of rotation is obtained due to the resiliency of the resilient arm portions 5*c*.

Here, the spring member 5 is provided with the auxiliary spring 5*e* which is brought into slide contact with the cam portion 4*c* of the rotary plate 4 corresponding to the slide contact of the projection 5*d* with the plateaus and the valleys of the cam surface 4*c*. Further, in the vicinity of the cam surface 4*c*, the auxiliary spring receiving portion 4*d* with which the auxiliary spring 5*e* is brought into slide contact is formed and the free ends of the auxiliary springs 5*e* are brought into slide contact with the auxiliary spring receiving portion 4*d* corresponding to the slide contact of the projection 5*d* with the plateaus and the valleys of the cam surface 4*c*. Accordingly, when the projection 5*d* of the spring member 5 is brought into slide contact with the plateaus and the valleys of the cam surface 4*c* and falls in the valley after getting over the plateau of the cam surface 4*c*, with the use of the resiliency of the auxiliary spring 5*e*, it becomes possible to prevent a switching sound (an impinging sound) generated at the time of manipulation from becoming large due to the sharp impinging or the vibration.

Further, in this case, as shown in FIG. 4, the auxiliary spring 5*e* is formed such that, when the projection 5*d* is engaged with the valley of the cam surface 4*c*, the free ends are in the state that both of them thrust against the auxiliary spring receiving portions 4*d* so that the pressing force applied to the auxiliary spring receiving portions 4*d* becomes maximum. Accordingly, the impinging speed of the projection 5*d* when the projection 5*d* falls in the valley can be surely decelerated.

Further, when the auxiliary spring 5*e* is moved along with the rotating manipulation of the rotary plate 4, the auxiliary spring 5*e* always stays in slide contact with the planar auxiliary spring receiving portion 4*d* and hence, the impinging speed of the projection 5*d* can be decelerated surely and in a stable manner.

Further, the auxiliary spring 5*e* is extended uniformly or symmetrically in both side directions with respect to the projection 5*d* along the circumferential direction of the rotation of the rotary plate 4. Accordingly, the auxiliary spring 5*e* can acquire the good balance so that the inclination of the spring member 5 due to the rotating direction of the rotary plate 4 can be prevented.

Along with the rotation of the rotary plate 4, the circuit board 3 which is mounted on the lower surface side of the rotary plate 4 is also rotated and the contact portions (not shown in the drawing) which are mounted on the circuit board 3 are brought into slide contact with the sliders 2*c* of the fixed terminal portion 2 which are disposed such that they face the contact portions in an opposed manner whereby the changeover of the switch is performed.

According to the constitution of the abovementioned embodiment, the auxiliary spring 5*e* is integrally formed with one end of the spring member 5 by forming a portion of the spring member 5 and hence, two springs can be easily integrally formed so that the assembly can be simply performed.

Further, the auxiliary spring receiving portion 4*d* is formed on the rotary plate 4 such that the auxiliary spring receiving member 4*d* forms an integral coplanar surface with the cam surface 4*c*. Accordingly, the auxiliary spring receiving portion 4*d* can be formed of the member which is identical with the member which constitutes the cam surface 4*c* with accuracy so that the occurrence of the irregularities of size in assembly can be eliminated and the impinging speed can be surely decelerated.

Further, the rotary plate 4 is rotatably supported on the support shaft 1*a* of the housing 1, the cam surface 4*c* and the spring member 5 having the projection 5*d* which faces the cam surface 4*c* in an opposed manner are arranged to face each other vertically with respect to the support shaft 1*a* of the housing 1, a portion of the spring member 5 is extended from a position in the vicinity of the projection 5*d* along the circumferential direction of the rotation of the rotary plate 4 so as to form the auxiliary spring 5, and the free ends of the auxiliary spring 5*e* are brought into contact with the auxiliary spring receiving portion 4*d*. Accordingly, without enlarging the contour of the switch, the span of the auxiliary spring can be ensured.

In the abovementioned embodiment, the cam surface 4*c* is formed on the upper surface side of the rotary plate 4 and the cam surface 4*c* and the spring member 5 are arranged to face each other vertically with respect to the support shaft 1*a* of the housing 1. However, different from such an arrangement, the cam surface 4*c* may be formed on the peripheral surface of the rotary plate 4 and the spring member 5 may be arranged in the side surface direction. Further, the manipulating member is not limited to the rotary plate 4 and it is needless to say that the manipulating member may be a slide member which is movable in the slide direction.

As has been described heretofore, the switch device according to the present invention includes the manipulating member having the cam surface which is formed of plateaus and valleys arranged contiguously and alternately and the spring member having the projection and generating the click feeling when the projection is brought into slide contact with the plateaus and the valleys of the cam surface. Further, the spring member is provided with the auxiliary spring which is brought into slide contact with the manipulating member corresponding to the slide contact of the projection with the plateaus and the valleys of the cam surface and the auxiliary spring receiving portion with which the auxiliary spring is brought into slide contact is formed in the vicinity of the cam surface. Accordingly, when the projection of the spring member is brought into slide contact with the plateaus and valleys of the cam surface and falls in the valley after getting over the plateau of the cam surface, the switching sound (the impinging sound) at the time of manipulation which is generated by the impingement or the vibration can be reduced.

Further, the auxiliary spring is integrally formed with one end of the spring member by forming a portion of the spring member and hence, the two springs can be easily integrally formed thus facilitating the assembling operation.

Further, the auxiliary spring is formed such that a pressing force applied to the auxiliary spring receiving portion becomes maximum when the projection is engaged with the valley of the cam surface. Accordingly, the impinging speed at the time the projection falls in the valley can be surely decelerated.

Further, the auxiliary spring receiving portion is formed on the manipulating member such that the auxiliary spring receiving member forms an integral coplanar surface with the cam surface. Accordingly, the auxiliary spring receiving portion can be formed with accuracy using the member identical with that of the cam surface so that the occurrence of the irregularities of size at the time of assembly can be eliminated whereby the impinging speed of the projection can be surely decelerated.

Further, the auxiliary spring is formed such that the auxiliary spring is in a slidable contact in the state that the auxiliary spring is always brought into contact with the planar auxiliary spring receiving portion. Accordingly, the impinging speed can be decelerated surely and in a stable manner.

Further, the support shaft formed in a cylindrical shape is mounted on the center of the accommodating portion of the housing, the manipulating member allows insertion of the support shaft thereinto and is rotatably supported by the support shaft, the cam surface and the spring member having the projection which faces the cam surface in an opposed manner are disposed in the vertical direction relative to the support shaft, and a portion of the spring member is extended along the circumferential direction of the rotation of the manipulating member from a position in the vicinity of the projection so as to form the auxiliary spring, and a free end of the auxiliary spring is brought into contact with the auxiliary spring receiving portion. Accordingly, the span of the auxiliary spring can be sufficiently ensured without enlarging the contour of the switch.

Further, the auxiliary spring is symmetrically extended toward both sides of the circumferential direction of the rotation of the manipulating member with respect to the projection. Accordingly, the auxiliary spring can acquire the good balance so that the inclination of the spring member due to the rotating direction of the manipulating portion can be prevented.

What is claimed is:

1. A switch device comprising:

a housing having an accommodating portion, a manipulating member having a cam surface which is formed of plateaus and valleys arranged contiguously and alternately, the manipulating member movably disposed in the accommodating portion, and a spring member having a projection and generating a click feeling when the projection is brought into slide contact with the plateaus and the valleys of the cam surface, wherein an auxiliary spring which is brought into slide contact with the manipulating member corresponding to the slide contact of the projection with the plateaus and the valleys of the cam surface is formed on the spring member, and wherein an auxiliary spring receiving portion with which the auxiliary spring is brought into slide contact is formed in the vicinity of the cam surface.

2. A switch device according to claim 1, wherein the auxiliary spring is integrally formed with one end of the spring member by forming a portion of the spring member.

3. A switch device according to claim 1, wherein the auxiliary spring is formed such that a pressing force applied to the auxiliary spring receiving portion becomes maximum when the projection is engaged with the valley of the cam surface.

4. A switch device according to claim 1, wherein the auxiliary spring receiving portion is formed on the manipulating member such that the auxiliary spring receiving portion forms an integral coplanar surface with the cam surface.

5. A switch device according to claim 1, wherein the auxiliary spring is formed such that the auxiliary spring is in a slidable contact in the state that the auxiliary spring always stays in contact with the planar auxiliary spring receiving portion when the manipulating member is moved.

6. A switch device according to claim 1, wherein a support shaft formed in a cylindrical shape is mounted on the center of the accommodating portion of the housing, wherein the manipulating member is rotatably supported by the support shaft, wherein the cam surface and the spring member having the projection which faces the cam surface in an opposed manner are disposed in a vertical direction relative to the support shaft, wherein a portion of the spring member is extended along the circumferential direction of rotation of the manipulating member from a position in the vicinity of the projection so as to form the auxiliary spring, and wherein a free end of the auxiliary spring is brought into contact with the auxiliary spring receiving portion.

7. A switch device according to claim 1, wherein the auxiliary spring is symmetrically extended toward both sides of the circumferential direction of the rotation of the manipulating member with respect to the projection.

* * * * *